US008083091B2

(12) United States Patent
Arteaga et al.

(10) Patent No.: US 8,083,091 B2
(45) Date of Patent: Dec. 27, 2011

(54) GARDENING REFUSE CONTAINER

(76) Inventors: Ruben Arteaga, Tujunga, CA (US); Ramiro Arteaga, Tujunga, CA (US)

( * ) Notice: Subject to any disclaimer, the term of this patent is extended or adjusted under 35 U.S.C. 154(b) by 465 days.

(21) Appl. No.: 12/287,197

(22) Filed: Oct. 8, 2008

(65) Prior Publication Data

US 2010/0084416 A1 Apr. 8, 2010

(51) Int. Cl.
*B65D 1/46* (2006.01)
*B65F 1/02* (2006.01)

(52) U.S. Cl. ..... 220/646; 220/908; 220/643; 220/640; 220/772

(58) Field of Classification Search ..... 220/908, 220/643, 640, 660, 608, 801, 772, 646
See application file for complete search history.

(56) References Cited

U.S. PATENT DOCUMENTS 1,965,647 A * 7/1934 Jackson ..... 220/23.2
3,170,183 A * 2/1965 Leatherman ..... 15/257.1
3,341,060 A * 9/1967 Rehrig ..... 220/643
5,582,322 A * 12/1996 Prout et al. ..... 220/771
5,897,018 A * 4/1999 Pruitt ..... 220/603
6,471,221 B1 * 10/2002 McGarry ..... 280/47.26
6,508,377 B1 * 1/2003 Griswold et al. ..... 220/495.06
6,808,081 B1 * 10/2004 Citro ..... 220/772
6,877,182 B1 * 4/2005 Hutson ..... 15/257.1
7,131,552 B2 * 11/2006 Simonson ..... 220/495.06
2010/0181316 A1 * 7/2010 Moore ..... 220/326

* cited by examiner

*Primary Examiner* — Stephen Castellano

(57) ABSTRACT

An improved gardening waste receptacle has an open top and presents an opening with square corners. The receptacle opening has an arced strip along one side of the rim on the interior for retaining scooped material, and a non-deformable strip extending along the same side of the rim on the exterior, and extending along the adjacent sides of the rim of the receptacle to prevent the opening from deforming when heated and put under pressure. Two handle means are disposed on the side of the receptacle opposite the strips; one handle, a recessed handle disposed into the lower portion of the wall of the receptacle, and another handle extending outward from the top of the wall. The outward extending handle presents a dowel that turns in position for ease of lifting and carrying.

20 Claims, 2 Drawing Sheets

GARDENING REFUSE CONTAINER

CROSS-REFERENCE TO RELATED APPLICATION

None

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

Waste receptacles are known in the art, as are receptacles for containing yard waste. In the current state of the art, receptacles have a tendency to heat up and easily deform, particularly when used outdoors. Another problem with the current art is that when pressure is applied to a receptacle, the rim of the receptacle deforms, making it difficult to insert yard waste. Also, as the majority of yard waste receptacles are cylindrical, it is difficult to scoop material into the mouth of the cylinder.

It is common for yard waste receptacles to be moved during gardening. This presents a problem with mobility, since if a receptacle must be moved into an area where it cannot be wheeled into position, it must be carried. Current waste receptacles in the art do not readily present a means of easily carrying the receptacle. Particularly, it is common for gardeners to carry a receptacle on their backs, and the receptacles of the current art are either inconveniently shaped for disposition on the back of a carrier, do not have readily accessible means of carrying, or present surface characteristics that injure the back of a user by bruising or scratching.

Therefore, it is an object of the present invention to provide a gardening waste receptacle with a profile that makes yard waste easy to insert. Another object of the present invention is to provide a gardening waste receptacle that avoids deforming due to heat and pressure. Another object of the present invention is to provide a gardening waste receptacle that has a means of easily lifting and carrying the receptacle on the back of a user without causing injury to the user. These and other objects will be come apparent from the appended Summary, Description and Claims.

SUMMARY

The present invention comprises an improved gardening refuse container. The container comprises four walls, a bottom and an open top, wherein each wall is disposed at an angle to the other so that the rim of the top is substantially square. The exterior walls of the receptacle are flush, with no features extending outward except a handle projecting from the top of the container.

A non-deformable strip is disposed on the exterior of the rim and recessed into the rim of the container so as to be flush with the walls. The non-deformable strip is disposed along one wall, and continues for a distance along the rim of the adjacent walls and prevents the receptacle from deforming due to heating by exposure to sunlight and external physical pressure.

An arced strip extends across the inside rim of the container on the wall opposite the non-deformable strip. The arced strip provides a scooping surface that prevents material in the container from exiting once inside. The scooping surface created by the arced strip also facilitates the entry of cuttings and other yard refuse into the receptacle.

A recessed handle is disposed in the lower portion of the wall opposite the non-deformable strip and does not extend beyond the plane of the wall on the exterior of the receptacle. The walls of the recess are flat, except for the side closest to the rim of the container, where an overlap presents a gripping profile. The recessed handle provides the ability to lift heavy loads by providing a lower gripping area on the device, and prevents the device from scratching or bruising the back of a user.

A projecting handle is disposed the same wall as the recessed handle, extending outward from the wall at the rim of the container. The projecting handle comprises a dowel member supported by supports extending from the wall. In various embodiments, two or more supports are used to anchor the dowel in place so that a user can maintain a grip on the dowel while lifting the container into a carrying position.

Wheels are disposed at the bottom of the container for mobility. The wheels allow the container to be pivoted and rolled into a position. The wheels are recessed into the body of the container to maintain a flush profile with the walls, and the walls of the container conform to the circular shape of the wheels.

In order to use the container, after creating gardening waste, the container is placed on the ground so the arced strip is against the ground and yard waste is scooped into the container. During this process, force can be applied to the container, and the non-deformable strip will prevent the mouth of the container deforming. A flat lid with a handle can be placed into the opening of the container to cover yard waste, but is not hinged to the container.

DETAILED DESCRIPTION

Figure 1:
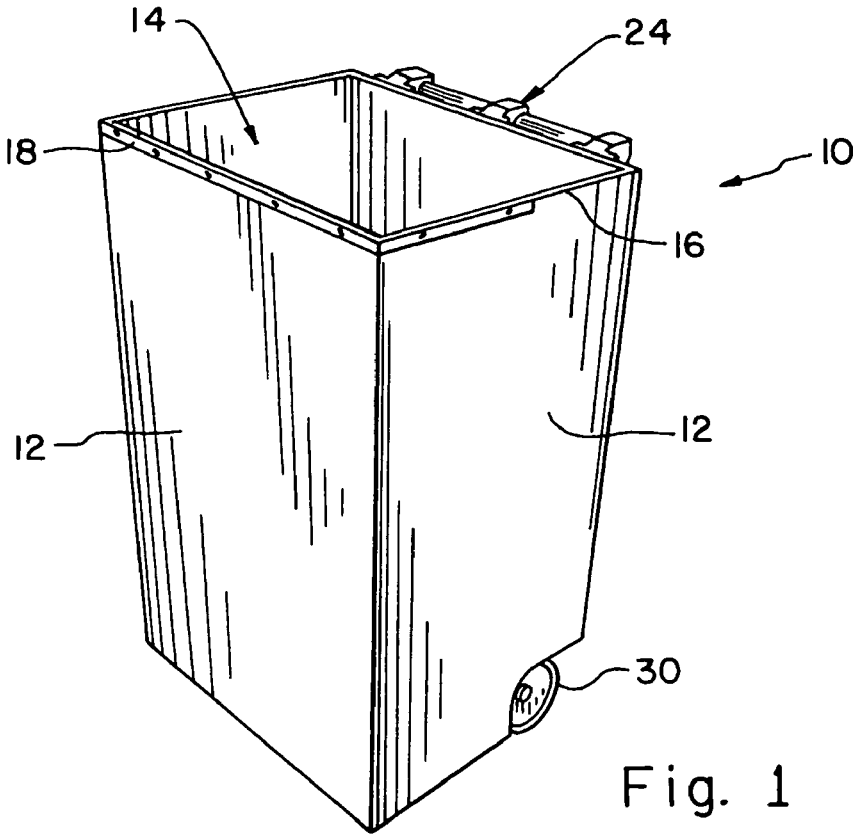
FIG. 1 is a perspective view of an improved garden waste receptacle.

Referring to FIG. 1, an improved gardening refuse container is shown and described. The receptacle 10 comprises four walls 12, a bottom (not shown) and an open top 14, wherein the junction of each wall 12 is disposed at an angle so that the rim 16 of the open top 14 presents substantially square angles. The exterior walls 12 of the receptacle 10 are flush, with no features extending outward except a projecting handle 24 at the top of the receptacle 10. In a preferred embodiment, the receptacle 10 is approximately 20 inches wide, 15 inches deep, and 35 inches tall, and has a volume of 35 gallons. In another preferred embodiment, the walls 12 of the receptacle 10 are sloped so that the perimeter of the rim 16 of the receptacle 10 is larger than the bottom perimeter of the receptacle 10.

Still referring to FIG. 1, a non-deformable strip 18 of material disposed at the exterior rim 16 of the receptacle 10, is recessed into the rim 16 of the receptacle 10 so as to be flush with the exterior of the receptacle walls 12. The non-deformable strip 18 is disposed along one wall 12, and continues for a distance along the rim of the adjacent walls to prevent the receptacle 10 from deforming. In one preferred embodiment, the strip 18 is made of rigid metal, preferably a non-corroding metal material.

Still referring to FIG. 1, the non-deformable strip 18 comprises a strip of material, preferably metal, which is ½ inch wide and ⅛ inch deep in cross section, and recessed into the exterior rim 16 of the receptacle 10. The non-deformable strip 18 continues along the rim of one wall and in one embodiment, extends at least half way along the rim of the adjacent walls to provide a rigid support that prevents the rim 16 of the receptacle 10 from deforming due to heating by exposure to sunlight, and external physical pressure.

Figure 2:
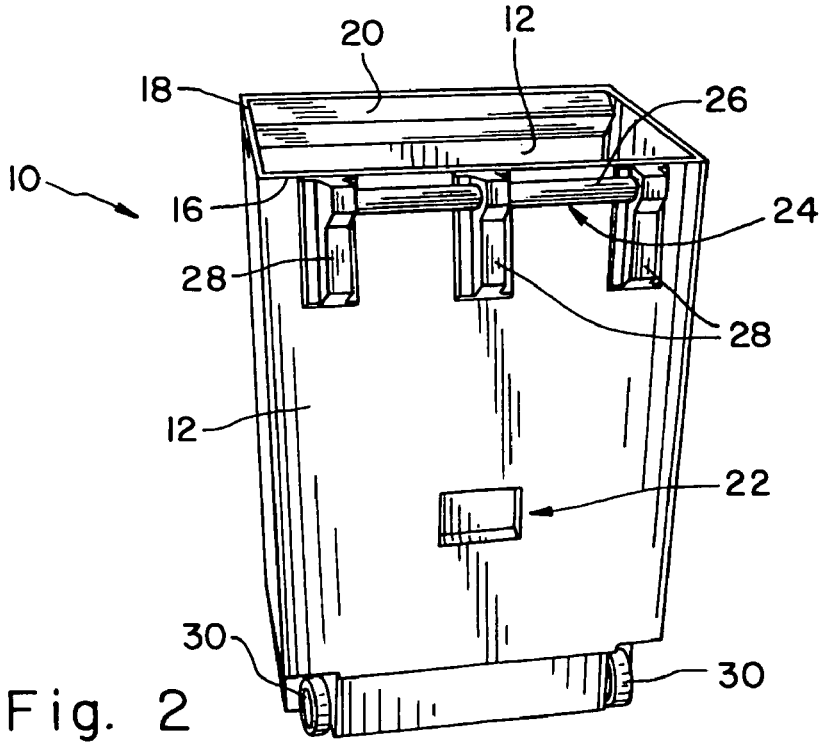
FIG. 2 is a rear view of an improved garden waste receptacle.

Referring to FIG. 2, an arced strip 20 comprising an elongated member extends across the inside rim 16 of the receptacle 10 on one wall adjacent to the non-deformable strip 18, wherein the arced strip 20 is arced in profile so as to slope away from the wall 12 toward the rim 16 of the receptacle 10, and back to the wall 12 toward the interior of the receptacle 10. In one preferred embodiment, the arced strip 20 is three inches wide.

Still referring to FIG. 2, a recessed handle 22 is disposed in the exterior lower portion of the wall opposite the non-deformable strip 18 and arced strip 20. The recessed handle 22 does not extend beyond the plane of the wall on the exterior of the receptacle 10. In one preferred embodiment, the recessed handle 22 is located on the centerline of the wall on which it is disposed, and the sides of the recess are flat, except for the side closest to the rim of the receptacle, where an overlap creates a gripping surface. In a preferred embodiment, the recessed handle 22 is four inches wide, three inches in height, and has a depth of 1.5 inches.

Still referring to FIG. 2, a projecting handle 24 is also disposed on the wall opposite the arced strip 20, extending from the exterior of the wall 12 at the rim 16 of the receptacle 10. The projecting handle 24 comprises a dowel member 26 supported by supports 28 extending from the wall 12 of the receptacle 10. In a preferred embodiment, the dowel member 26 is permitted to rotate in position, so that a user can maintain a grip on the dowel member 26 while lifting the receptacle 10 into a position where the receptacle is carried on the back. In a further preferred embodiment, the dowel member 26 is at least 13.5 inches long. In still another preferred embodiment, the dowel member 26 is at least ⅞ inch thick.

Still referring to FIG. 2, the receptacle 10 comprises wheels 30 disposed at the bottom of the receptacle for mobility. The wheels 30 allow the receptacle 10 to be pivoted and rolled into position. In one preferred embodiment, the wheels 30 are recessed into the body of the receptacle 10 to maintain the flush profile of the walls 12. In a further preferred embodiment, the walls 12 of the receptacle 10 conform to the circular shape of the wheels 30 at the junction of the wheels and the body.

Figure 3:
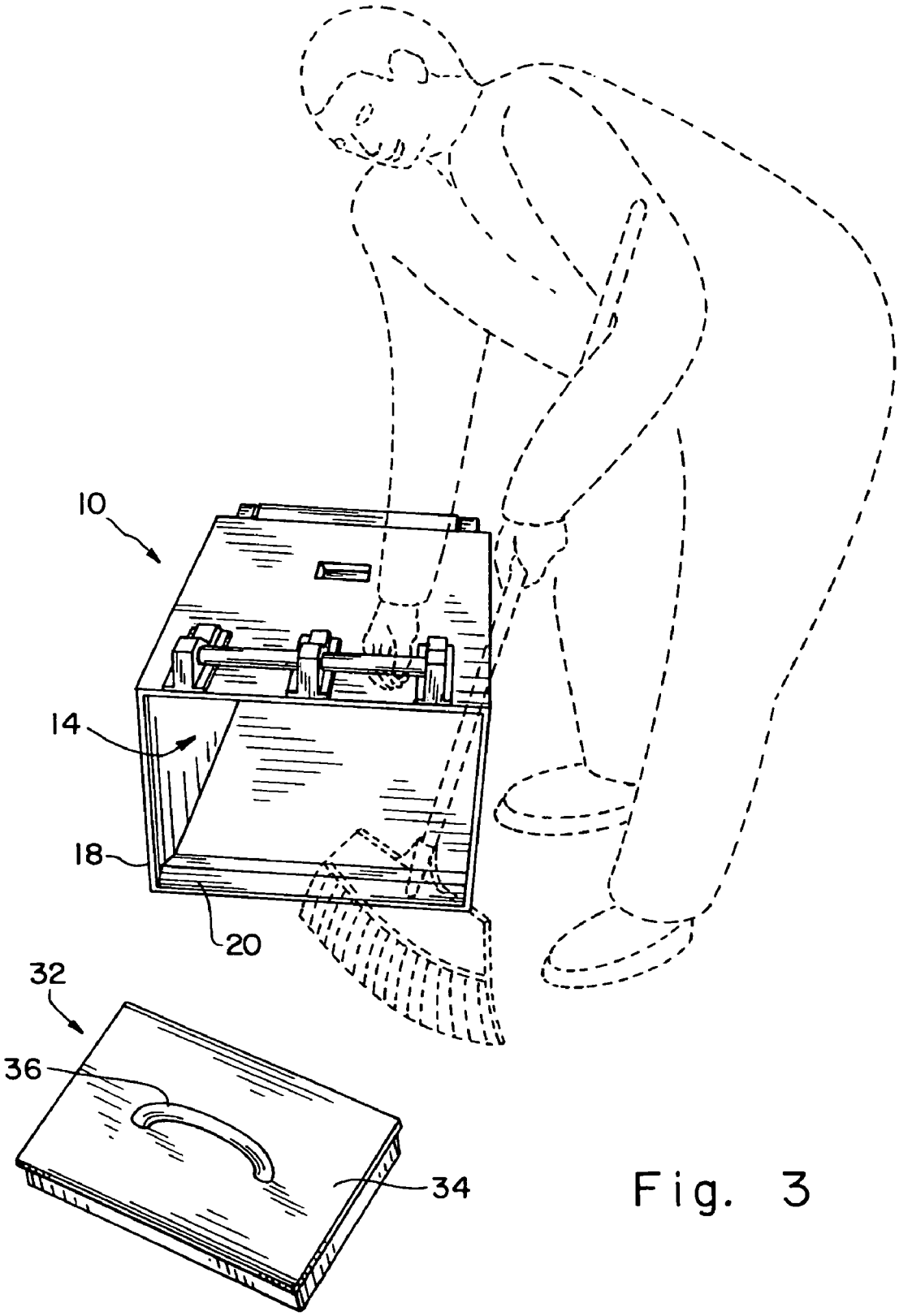
FIG. 3 is a perspective view of an improved garden waste receptacle in use, including a lid for covering the receptacle.

Referring to FIG. 3, the gardening receptacle is shown and described in use. In order to use the receptacle 10, after creating gardening waste, the receptacle 10 is disposed on the ground so that the arced strip 20 is adjacent to the ground and yard waste. Yard waste is scooped into the receptacle 10, over the arced strip 20. During this process, force can be applied to the receptacle 10, and the non-deformable strip 20 will prevent the mouth of the receptacle 10 from deforming.

Still referring to FIG. 3, in another preferred embodiment, the receptacle 10 comprises a lid 32 comprising a substantially planar member 34 and a handle means 36 for lifting the planar member 34. The lid 32 covers the opening of the receptacle 10 without being hinged to the receptacle 10, and the lid 32 fits into the opening 14 of the receptacle 10.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. An improved gardening refuse container, comprising:

a. a receptacle comprising four walls, a bottom, and an open top, wherein the junction of each wall is disposed at an angle so that the rim of the top presents substantially square angles;

b. a first strip, comprising an elongated member extending across the inside rim of the receptacle along one wall, wherein the strip is arced so as to present an upward slope toward the rim of the receptacle and a downward slope to the interior of the receptacle;

c. a first handle means recessed into the exterior lower mid-section of the wall opposite the first strip, wherein the handle means does not extend beyond the plane of the wall's surface on the exterior of the receptacle;

d. a second handle means also disposed on the wall opposite the first strip, extending from the exterior of the wall at the rim of the receptacle; and e. a second strip of non-deformable material disposed at the rim of the receptacle, wherein the second strip is recessed into the exterior rim of the receptacle so as to be flush with the exterior of the receptacle walls, and wherein the second strip is disposed only along same wall as the first strip, and continues only for a short distance along the exterior rim of the two adjacent walls to prevent the receptacle from deforming.

2. The receptacle of claim 1, wherein the exterior walls of the receptacle are flat with no features extending outward, except the second handle.

3. The receptacle of claim 1, wherein the receptacle is approximately 20 inches wide, 15 inches deep, and 35 inches tall.

4. The receptacle of claim 1, wherein the receptacle has a volume of 35 gallons.

5. The receptacle of claim 1, wherein the walls are sloped so that the perimeter of the opening of the receptacle is larger than the bottom perimeter of the receptacle.

6. The receptacle of claim 1, wherein the receptacle comprises wheels disposed at the bottom of the receptacle for mobility.

7. The receptacle of claim 6, wherein the wheels are recessed into the body of the receptacle.

8. The receptacle of claim 6, wherein the walls of the receptacle conform to the circular shape of the wheels at the junction of the wheels and the body.

9. The receptacle of claim 1, wherein the first strip is three inches wide.

10. The receptacle of claim 1, wherein the first handle means is located on the centerline of the wall on which it is disposed, and comprises a recess, wherein an overlap on the side of the recess closest to the rim of the receptacle creates a handle.

11. The receptacle of claim 1, wherein the second handle means comprises a dowel member supported by supports extending from the wall of the receptacle.

12. The receptacle of claim 11, wherein the dowel of the second handle means is permitted to rotate in position.

13. The receptacle of claim 11, wherein the dowel is at least 13.5 inches long.

14. The receptacle of claim 11, wherein the dowel is at least ⅞ inch thick.

15. The receptacle of claim 1, wherein the second strip comprises a non-deformable strip, ½ inch wide and ⅛ inch deep in cross section, recessed into the exterior rim of the receptacle.

16. The receptacle of claim 1, wherein the second strip continues along the rim of the walls adjacent to the first strip, extending at least half way to the rim of the wall opposite the first strip.

17. The receptacle of claim 1, wherein the second strip is made of metal.

18. The receptacle of claim 1, wherein a lid member comprising a substantially planar member and a handle means for lifting the member covers the opening of the receptacle without being hinged to the receptacle.

19. The receptacle of claim 18, wherein the lid member fits into the opening of the receptacle.

20. An improved gardening refuse container, comprising:

a. a receptacle comprising four walls, a bottom, and an open top, wherein the junction of each wall is disposed at an angle so that the rim of the top presents substantially square angles;

b. a set of wheels disposed at the bottom of the receptacle and recessed into the receptacle for mobility;

c. a first strip, comprising a 3 inch wide elongated member extending across the inside rim of the receptacle along one wall, wherein the strip is arced, so as to present an upward slope toward the open top of the receptacle and a downward slope to the interior of the receptacle;

d. a first handle means recessed into the lower portion of the wall opposite the first strip for lifting the receptacle, wherein the handle means does not extend beyond the plane of the wall's surface on the exterior of the receptacle, and the recessed portion of the handle means is approximately 4 inches wide by 3 inches tall by 1.5 inches deep;

e. a second handle means disposed on the outer surface of the wall opposite the first strip at the rim of the receptacle, comprising a dowel supported by support members that allow the dowel to turn in place; and f. a second strip of non-deformable material disposed at the rim of the receptacle, wherein the second strip is recessed into the exterior rim of the receptacle so as to be flush with the exterior of the receptacle walls, and wherein the second strip is disposed along same wall as the first strip, and continues for a distance along the exterior rim of the two adjacent walls to prevent the receptacle from deforming.

* * * * *